US006283075B1

(12) United States Patent
Schäfer et al.

(10) Patent No.: US 6,283,075 B1
(45) Date of Patent: Sep. 4, 2001

(54) LOCKING UNIT FOR A DEVICE FOR MODIFYING THE TIMING OF CHARGE CHANGE VALVES IN INTERNAL COMBUSTION ENGINES, ESPECIALLY FOR A VANE-CELL CONTROL DEVICE

(75) Inventors: Jens Schäfer, Herzogenaurach; Joachim Dietz, Frensdorf; Andreas Strauss, Herzogenaurach, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/601,549

(22) PCT Filed: Nov. 20, 1998

(86) PCT No.: PCT/EP98/07466

§ 371 Date: Aug. 1, 2000

§ 102(e) Date: Aug. 1, 2000

(87) PCT Pub. No.: WO99/43929

PCT Pub. Date: Sep. 2, 1999

(30) Foreign Application Priority Data

Feb. 28, 1998 (DE) ..... 198 08 618

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,724,929 * 3/1998 Mikame et al. ..... 123/90.17

5,823,152 * 10/1998 Ushida ..... 123/90.17

* cited by examiner

*Primary Examiner*—Weilun Lo
(74) *Attorney, Agent, or Firm*—Bierman, Muserlian and Lucas

(57) ABSTRACT

The invention relates to a locking unit for a device for modifying the timing of charge change valves of an internal combustion engine, especially for a vane-cell control device. Said device (1) comprises a drive wheel (3) presenting a hollow space (8) and connected to a crankshaft of the internal combustion engine in a driving manner. The device also comprises an impeller (9) which has at least one vane (13) and is connected to the camshaft (2) in a non-rotating manner. At least one working chamber (20), which is divided by a vane (13) into two hydraulic pressure chambers (21, 22), is formed by intermediate walls (16) in the hollow space (8) of the drive wheel (3). When the pressure chambers (21, 22) are subjected to pressure by means of a hydraulic pressure medium they cause the impeller (9) to pivot in relation to the drive wheel (3). When there is no pressure in one of the two pressure chambers (21, 22) the impeller (9) and the drive wheel (3) are mechanically coupled to each other. According to the invention the mechanical coupling between the impeller (9) and the drive wheel (3) of the device (1) can be achieved by means of at least one radially movable vane (13) of the impeller (9) which is configured as both an impeller pivoting element and a locking element.

7 Claims, 3 Drawing Sheets

LOCKING UNIT FOR A DEVICE FOR MODIFYING THE TIMING OF CHARGE CHANGE VALVES IN INTERNAL COMBUSTION ENGINES, ESPECIALLY FOR A VANE-CELL CONTROL DEVICE

This application is a 371 of PCT/EP98/07466 filed Nov. 20, 1998.

FIELD OF THE INVENTION

The invention concerns a locking device for a device for varying valve timing of gas exchange valves of an internal combustion engine, particularly for a vane-type adjusting device, said locking device comprising a drive pinion configured as an outer rotor and connected in driving relationship to a crankshaft of the internal combustion engine by a traction means, said drive pinion having a hollow space defined by a circumferential wall and two side walls, and a winged wheel inserted into this hollow space and configured as an inner rotor which is connected rotationally fast to a camshaft of the internal combustion engine, said winged wheel comprising on the periphery of its wheel hub at least one wing that is arranged in an axial groove and extends radially away from the wheel hub, at least one working chamber being defined within the hollow space of the drive pinion by intermediate walls that start from the inner surface of the circumferential wall of the drive pinion and extend toward the central longitudinal axis of the device, said working chamber being divided by a wing of the winged wheel extending in each working chamber into two hydraulic pressure chambers which, by an optional successive or simultaneous pressurizing by a hydraulic pressure medium, effect a turning and/or fixing of the winged wheel relative to the drive pinion, while in the absence of pressure loading of one of the pressure chambers, the winged wheel and the drive pinion can be coupled to each other mechanically in at least one preferred position.

BACKGROUND OF THE INVENTION

A generic device of the pre-cited type is known from U.S. Pat. No. 4,858,572. In a preferred embodiment of this device, six equally large working chambers are formed in the hollow space of the drive pinion between six circumferentially opposed intermediate walls. These six working chambers are divided into fluid-tight first and second pressure chambers by six wings rigidly connected to the hub of a winged wheel which is connected to the camshaft. The mechanical coupling between the winged wheel and the drive pinion of the device is accomplished by a spring-loaded locking pin arranged in a radial bore of one of the intermediate walls. This locking pin engages a reception bore arranged between two wings in the hub when the wings of the winged wheel abut in an end position against the intermediate walls of the drive pinion and the first pressure chambers of the device are cut off from the pressurization by the hydraulic pressure medium. When, upon a renewed pressurization of these pressure chambers, the hydraulic medium pressure exceeds a set value, the locking pin is displaced against the force of its spring entirely out of the reception bore in the hub into the radial bore in the intermediate wall so that the mechanical coupling between the winged wheel and the drive pinion is released. When, after a relative rotation between the winged wheel and the drive pinion, the wings are brought into abutment in their opposite end position against the intermediate walls of the drive pinion, and the second pressure chambers of the device are cut off from the pressurization by the hydraulic pressure medium, a second mechanical coupling between the winged wheel and the drive pinion is effected by a locking pin similarly arranged in another intermediate wall. This locking action is likewise undone when a defined pressure medium pressure in the second pressure chambers is exceeded.

A mechanical coupling of this type between the winged wheel and the drive pinion, however, has the drawback that it is formed by a plurality of additional separate components which in view of the extra expenses for their fabrication and assembly disadvantageously increase the manufacturing costs of such a vane-type adjusting device. Also, due to the configuration of the locking pins as simple pressure pins, there exists the possible drawback that the locking pins be deformed when they have been subject to high stresses acting in both directions of rotation so that a continued, satisfactory locking of the device is then not always guaranteed.

OBJECT OF THE INVENTION

The object of the invention is therefore to conceive a locking device for a device for varying the valve timing of gas exchange valves of an internal combustion engine, particularly for a vane-type adjusting device, which locking device should comprise the smallest possible number of separate components so that its manufacturing and assembly costs are low, and said locking device must guarantee a continued, satisfactory locking of the adjusting device even after taking up high stresses in both directions of rotation.

SUMMARY OF THE INVENTION

In accordance with the invention, this object is achieved with a device for varying valve timing of gas exchanqe valves of an internal combustion engine, particularly for a vane-type adjusting device, said locking device comprising a drive pinion (3) configured as an outer rotor and connected in driving relationship to a crankshaft of the internal combustion engine by a traction means, said drive pinion having a hollow space (8) defined by a circumferential wall (4) and two side walls (6,7), and a winged wheel (9) inserted into this hollow space (8) and configured as an inner rotor which is connected rotationally fast to a camshaft (2) of the internal combustion engine, said winged wheel (9) comprising on the periphery (10) of its wheel hub (11) at least one wing (13) that is arranged in an axial groove (12) and extends radially away from the wheel hub (11), at least one working chamber (20) being defined within the hollow space (8) of the drive pinion (3) by intermediate walls (16) that start from the inner surface (5) of the circumferential wall (4) of the drive pinion (3) and extend toward the central longitudinal axis of the device (1), said working chamber (20) being divided by a wing (13) of the winged wheel (9) extending in each working chamber (20) into two hydraulic pressure chambers (21, 22) which, by an optional successive or simultaneous pressurizing by a hydraulic pressure medium, effect a tuning and/or fixing of the winged wheel (9) relative to the drive pinion (3), while in the absence of pressure loading of one of the pressure chambers (21 or 22), the winged wheel (9) and the drive pinion (3) can be coupled to each other mechanically in at least one preferred position. By the fact that the mechanical coupling between the winged wheel and the drive pinion of the device can be established by at least one wing of the winged wheel, which wing is configured both as a pivoting element of the winged wheel and as a locking element which can be arrested in a locking position on the drive pinion by an auxiliary energy when a pressure of the hydraulic pressure medium falls short of a pressure required for pivoting the winged wheel, and which can be arrested in a releasing/pivoting position within its associated working chamber when a defined value of hydraulic pressure medium pressure is exceeded.

According to a further advantageous feature of the invention, each wing of the winged wheel configured as a locking element is arranged for radial movement within its axial groove in the wheel hub of the winged wheel, and a free end of said wing is in positive engagement with a corresponding axial fixing groove in the inner surface of the circumferential wall of the drive pinion in one or more locking positions of the device. Each axial fixing groove preferably extends over the entire width of the inner surface of the circumferential wall of the drive pinion, and a width of the axial fixing groove is such that the wing concerned can slip easily into said axial fixing groove while, at the same time, a rattling of the wing in its locking position is prevented.

It has proved to be particularly economic to configure only one wing of the winged wheel as a locking element irrespective of the number of wings present. This one wing is then in locking connection only in one of its end positions with an axial fixing groove which directly adjoins one of the two intermediate walls that define its working chamber or pressure chambers. However, the scope of the invention also includes solutions in which two or more wings are configured as locking elements which can be locked either in one of their end positions or, by arranging a further axial fixing groove on the second intermediate wall in each working chamber, even in both their end positions. It is equally possible to configure one or more of the wings for locking in one of the end positions and one or more wings for locking in the other end position of the wings and/or, by arranging further axial fixing grooves in the working chambers, to fix the winged wheel in one or more positions between the end positions if this is required for certain operating conditions of the internal combustion engine.

According to a further feature of the locking device of the invention, it is proposed to produce the auxiliary energy required for locking the wing in its locking position by spring means supported at one end on the groove bottom of the axial groove of the wheel hub and at the other end on the hub-proximate end of the wing. It has proved to be particularly advantageous to make the spring means as a leaf spring of spring steel and to insert it in longitudinal direction into the axial groove of the wing that is configured as a locking element. However, it is also possible to produce the auxiliary energy by coiled pressure springs or other suitable spring means let into the groove bottom of the axial groove and into guide bores in the hub-proximate end of the wing.

According to another feature of the invention, the free end of the wing configured as a locking element is slightly chamfered in radial direction and configured as a pressure-application surface for the hydraulic pressure medium for the unlocking position of the wing. A separate pressure medium supply duct opens into the widened gap thus formed between the free end of the wing and the groove bottom of the axial fixing groove and communicates with the pressure medium supply duct of the pressure chamber of the working chamber containing the axial fixing groove. In a preferred embodiment, the separate pressure medium supply duct to the free end of the wing is configured in the drive pinion as an edge bevel on one of the two lateral edges of the intermediate wall adjoining the axial fixing groove and defining the pressure chamber. When this pressure chamber is pressurized, the hydraulic pressure medium acts at first along this edge bevel and, confined by the locked wing and one of the side walls of the drive pinion, on the chamfered free end of the wing. When a defined pressure medium pressure is exceeded, the hydraulic pressure medium displaces the wing against its auxiliary energy into its unlocking position. It is only after this that the pressure medium can bring about a change in the volume of the pressure chamber and thus effect a rotation of the winged wheel relative to the drive pinion. In an alternative embodiment, however, it is also possible to configure the separate pressure medium supply duct to the free end of the wing as a pressure medium guide groove on the inner surface of one of the two side walls of the drive pinion. This guide groove is arranged at the level of and parallel to the lateral surface of the intermediate wall adjoining the axial fixing groove and defining the pressure chamber. The action of the guide groove is similar to that of the aforesaid edge bevel.

Thus, the locking device of the invention for a vane-type adjusting device for varying the valve timing of gas exchange valves of an internal combustion engine has the advantage over known locking devices that, due to the simultaneous use of a wing of the winged wheel both as a pivoting and a locking element, only a minimum of additional individual elements or work steps is required for realizing a locking of the winged wheel relative to the drive pinion in one or more positions. Thus, the locking device of the invention contrasts advantageously with known locking devices by an enormous economy of material and production steps, so that the manufacturing costs of a vane-type adjusting device comprising such a locking device are only unsubstantially higher than those of a vane-type adjusting device having no locking device. Furthermore, the locking device of the invention possesses a high degree of operating reliability with regard to the accommodation of high stresses in both directions of rotation because the wing which functions as a locking element is locked over its entire width in a fixing groove that likewise extends over the entire width of the circumferential wall of the drive pinion so that the locking element possesses the force-supporting capacity which is required for assuring a stable and reliable locking.

BRIEF DESCRIPTION OF THE DRAWINGS

The invention will now be described more closely with reference to an example of embodiment illustrated in the appended drawings in which.

DETAILED DESCRIPTION OF THE DRAWINGS

Figure 1:
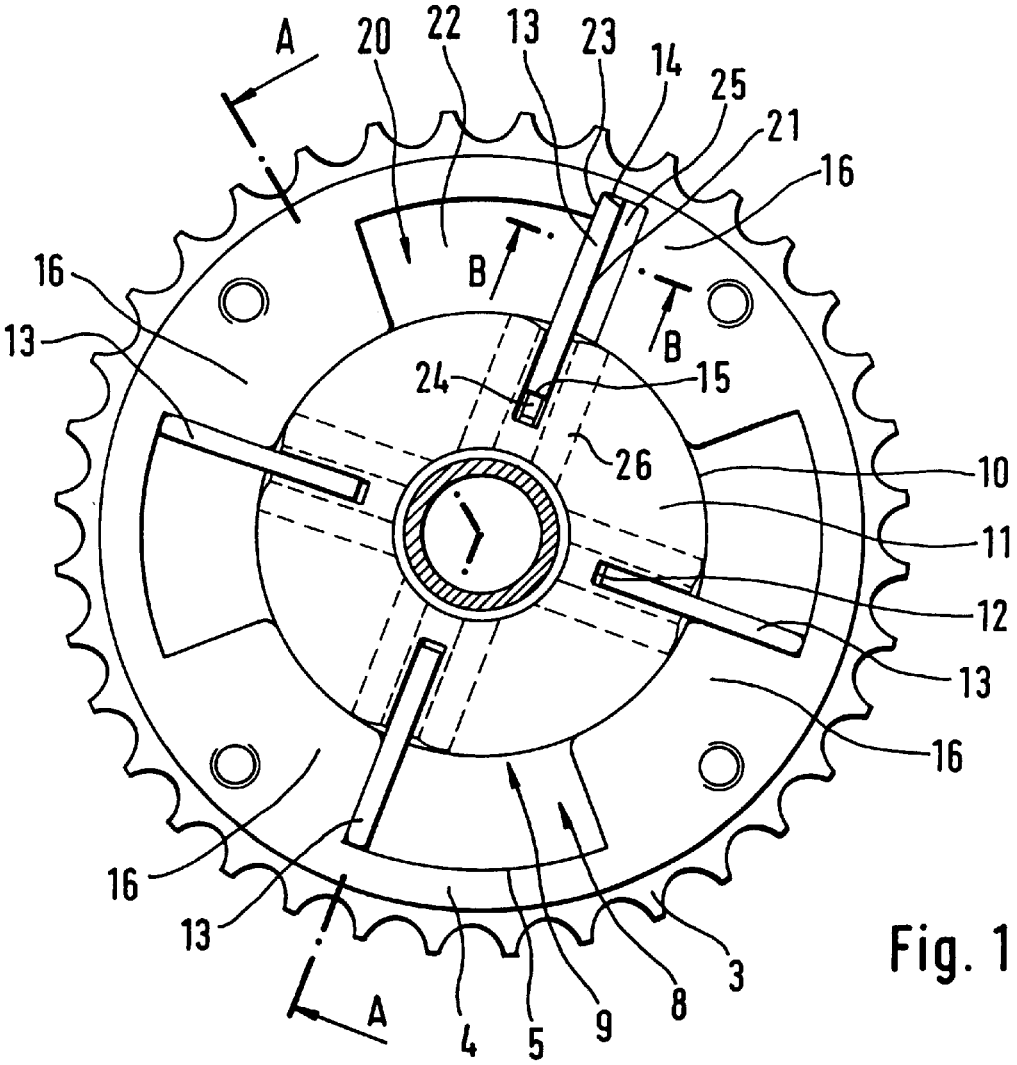
FIG. 1 is a top view of a vane-type adjusting device having a locking device of the invention, with removed housing side wall.
Figure 2:
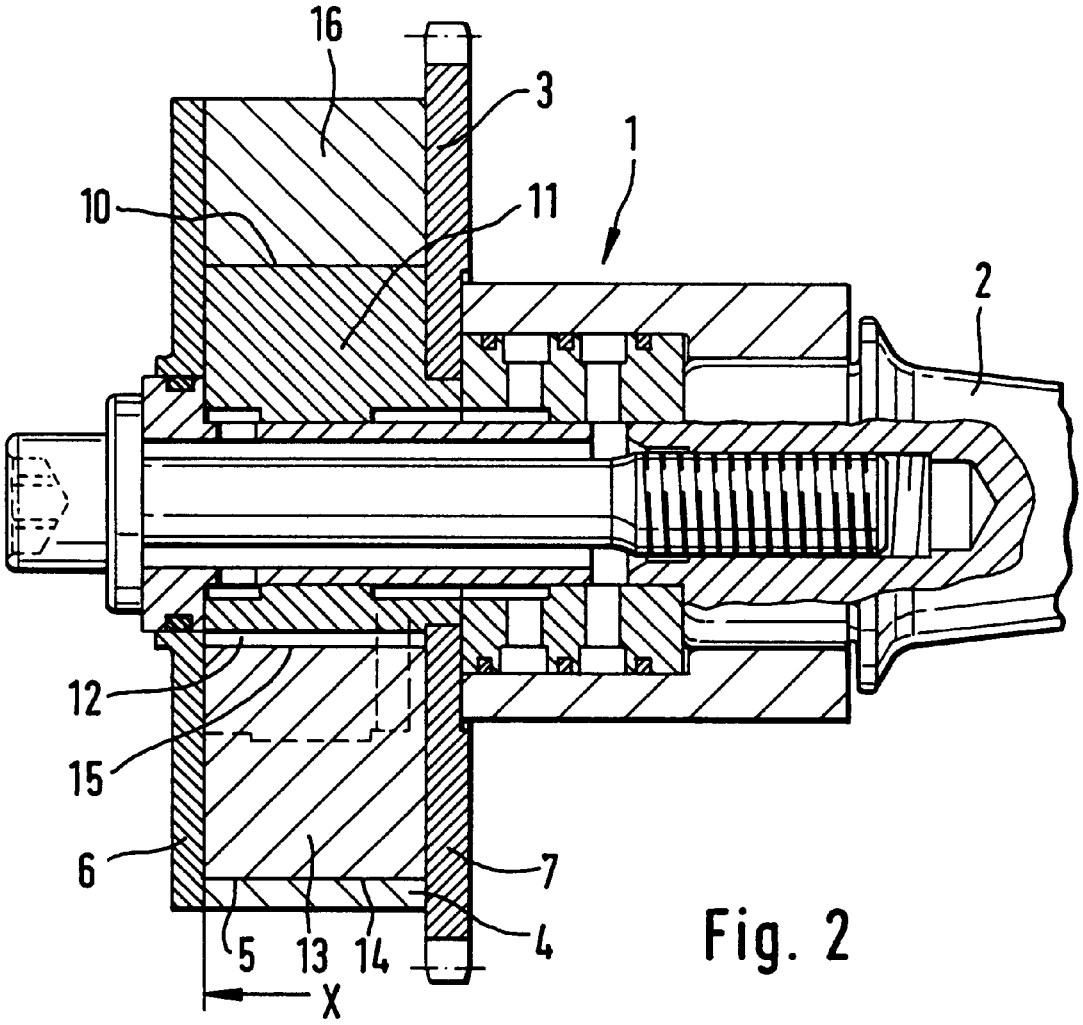
FIG. 2 is a side view of a vane-type adjusting device along the sectional line A—A of FIG. 1.

FIG. 1 clearly shows a device 1 configured as a vane-type adjusting device for varying the valve timing of gas exchange valves of an internal combustion engine, said device comprising a drive pinion 3 configured as an outer rotor and connected in driving relationship to a crankshaft, not shown, of the internal combustion engine by a traction means, and a winged wheel 9 configured as an inner rotor which is connected rotationally fast to a camshaft 2 of the internal combustion engine. FIGS. 1 and 2 further show that the drive pinion 3 comprises a hollow space 8 defined by a circumferential wall 4 and two side walls 6 and 7, in which hollow space 8, four working chambers 20 are defined by four intermediate walls 16 starting from the inner surface 5 of the circumferential wall 4 and extending towards the central longitudinal axis of the device 1. The winged wheel 9 is inserted into this hollow space 8 and comprises on the periphery 10 of its wheel hub 11, four wings 13, each of which is arranged in an axial groove 12 and extends radially away from the wheel hub 11. Each wing 13 extends in one of the four working chambers 20 of the drive pinion 3 and divides this working chamber into two hydraulic pressure chambers 21, 22. Thus, by an optional successive or simultaneous pressurizing of these pressure chambers 21, 22 by a hydraulic pressure medium, a pivoting and/or fixing of the winged wheel 9 relative to the drive pinion 3 can be realized, so that the camshaft 2 pivots and/or is hydraulically fixed relative to the crankshaft of the internal combustion engine in a manner, known per se.

Since the device 1 is in a virtually pressureless state when the internal combustion engine is started, the alternating torques of the camshaft 2 lead to a high-frequency abutment of the wings 13 of the winged wheel 9 against the intermediate walls 16 of the drive pinion 3 which results in an undesired generation of noise. The device of the invention that establishes a mechanical coupling, known per se, between the winged wheel 9 and the drive pinion 3 prevents such a noise generation by the fact that at least one wing 13 of the winged wheel 9 is configured both as a pivoting element of the winged wheel and as a locking element which, when the pressure of the hydraulic pressure medium falls short of a pressure required for pivoting the winged wheel 9 can be arrested in a locking position on the drive pinion 3 by the action of an auxiliary energy, and when the pressure of the hydraulic pressure medium exceeds a defined pressure, said locking element can be arrested in an unlocking/pivoting position within its associated working chamber 20.

It can be seen in FIG. 1 that only one of the four wings 13 of the winged wheel 9 is configured as a locking element in that this wing 13 is arranged for radial displacement in its axial groove 12 in the wheel hub 11 of the winged wheel 9 while its free end 14 is in positive engagement with an axial fixing groove 23 in the inner surface 5 of the circumferential wall 4 of the drive pinion 3. In the present embodiment of the invention, this axial fixing groove 23 is arranged immediately adjoining the intermediate wall 16 which defines the working chamber 20, or pressure chamber 21, so that the wing 13 can be arrested on the drive pinion 3 only in one of its end positions, in the present case, in the start position of the camshaft 2 which is favorable for starting the internal combustion engine. The auxiliary energy required for arresting the wing 13 in its locking position is produced by a spring means 24 in the form of a leaf spring, only schematically represented in FIG. 1, which is supported at one end on the groove bottom of the axial groove 12 in the wheel hub 11, and at the other end on the hub-proximate end 15 of the wing 13.

Figure 3:
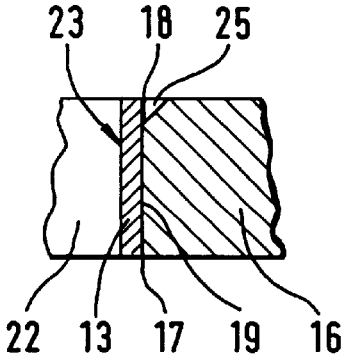
FIG. 3 is a top view of a wing of the winged wheel configured according to the invention as a locking element, showing one embodiment of the pressure medium supply to the free end of the wing along the sectional line B—B of FIG. 1.
Figure 4:
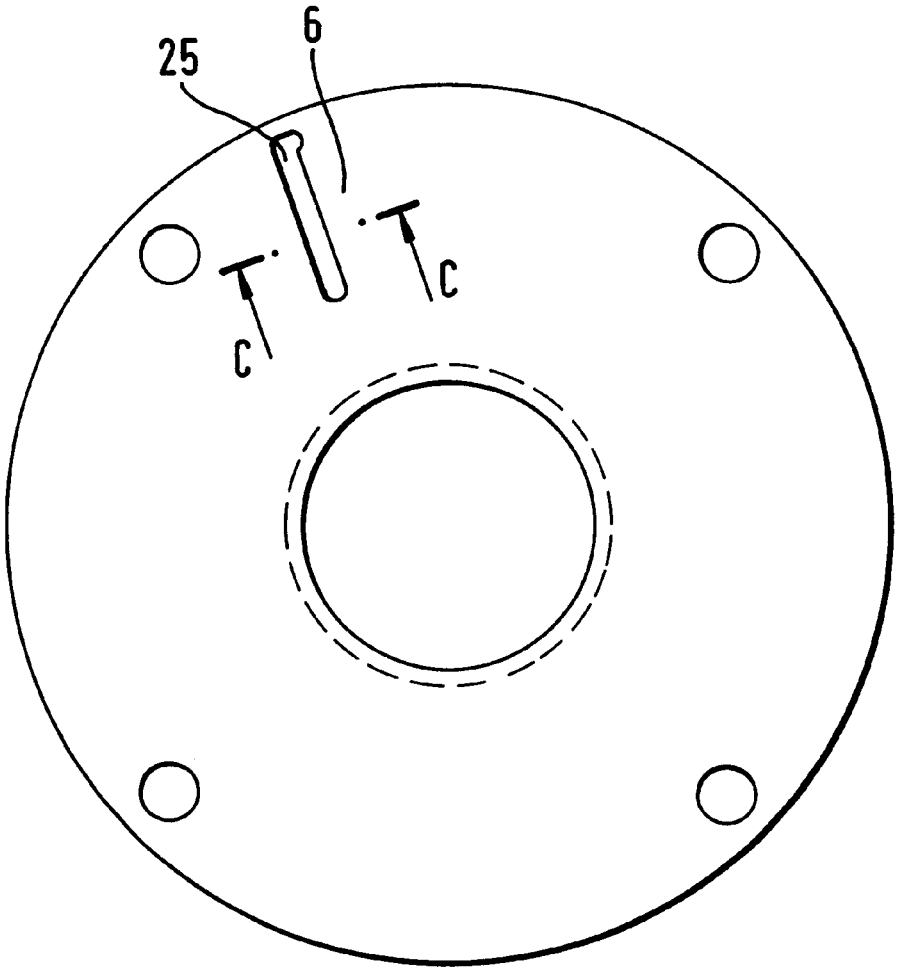
FIG. 4 shows the view X of FIG. 3 of the inner surface of a side wall of the drive pinion with another embodiment of the pressure medium supply to the free end of a wing of the winged wheel configured according to the invention as a locking element.
Figure 5:
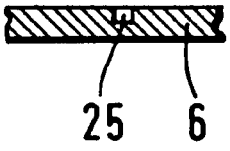
FIG. 5 shows a section taken along line C—C of FIG. 4.

For releasing the device 1 from its locking position, i.e. for returning the wing 13 into its unlocking position, the invention further provides that the free end 14 of the wing 13, as generally shown in FIG. 1, is slightly chamfered in radial direction and configured as a pressure-application surface for the hydraulic pressure medium. A separate pressure medium supply duct 25 opens into the widened gap thus formed between the free end 14 of the wing 13 and the groove bottom of the axial fixing groove 23 and communicates with the pressure medium supply duct 26 of the pressure chamber 21 of the working chamber 20 in which the axial fixing groove 23 is arranged. In a first embodiment represented in FIGS. 1 to 3, this separate pressure medium supply duct 25 is configured in the drive pinion 3 as an edge bevel on one of the lateral edges 17, 18 of the intermediate wall 16 defining the pressure chamber 21. Said supply duct 25 is further defined by the locked wing 13 and by one of the side walls 6, 7 of the drive pinion 3 so that it has a triangular cross-section through which the hydraulic pressure medium from the pressure medium supply duct 26 can be transported to the free end 14 of the wing 13. In an alternative embodiment shown in FIGS. 4 and 5, the separate pressure medium supply duct 25 to the free end 14 of the wing 13 can be configured, for example, as a pressure medium guide groove on the inner surface of the side wall 6 of the drive pinion 3 and is arranged at the level of and parallel to the lateral surface 19 (FIG. 3) of the intermediate wall 16 adjoining the axial fixing groove 23 and defining the pressure chamber 21 while itself being closed on its open side by this intermediate wall 16.

What is claimed is:

1. A locking device for a device for varying valve timing of gas exchange valves of an internal combustion engine, including for a vane-type adjusting device, said locking device comprising a drive pinion (3) configured as an outer rotor and connected in driving relationship to a crankshaft of the internal combustion engine by a traction means, said drive pinion having a hollow space (8) defined by a circumferential wall (4) and two side walls (6, 7), and a winged wheel (9) inserted into this hollow space (8) and configured as an inner rotor which is connected rotationally fast to a camshaft (2) of the internal combustion engine, said winged wheel (9) comprising on the periphery (10) of its wheel hub (11) at least one wing (13) that is arranged in an axial groove (12) and extends radially away from the wheel hub (11), at least one working chamber (20) being defined within the hollow space (8) of the drive pinion (3) by intermediate walls (16) that start from the inner surface (5) of the circumferential wall (4) of the drive pinion (3) and extend toward the central longitudinal axis of the device (1), said working chamber (20) being divided by a wing (13) of the winged wheel (9) extending in each working chamber (20) into two hydraulic pressure chambers (21, 22) which, by an optional successive or simultaneous pressurizing by a hydraulic pressure medium, effect a turning or fixing of the winged wheel (9) relative to the drive pinion (3), while in the absence of pressure loading of one of the pressure chambers (21 or 22), the winged wheel (9) and the drive pinion (3) can be coupled to each other mechanically in at least one preferred position, characterized in that a mechanical coupling between the winged wheel (9) and the drive pinion (3) of the device (1) is established by at least one wing (13) of the winged wheel (9), which wing (13) is configured both as a pivoting element of the winged wheel (9) and as a locking element which is arrested in a locking position on the drive pinion (3) when a pressure of the hydraulic pressure medium falls short of a pressure required for pivoting the winged wheel (9), and which is arrested in a releasing/pivoting position within its working chamber (20) when a defined value of hydraulic pressure medium pressure is exceeded.

2. A locking device according to claim 1, characterized in that each wing (13) of the winged wheel (9) configured as a locking element is arranged for radial movement within its axial groove (12) in the wheel hub (11) of the winged wheel (9) and a free end (14) of said wing is in positive engagement with a corresponding axial fixing groove (23) in the inner surface (5) of the circumferential wall (4) of the drive pinion (3) in one or more locking positions of the device (1).

3. A locking device according to claim 2, characterized in that only one wing (13) of the winged wheel (9) is configured as a locking element and is in locking connection only in one of its end positions with an axial fixing groove (23) which directly adjoins one of the two intermediate walls (16) that define its working chamber (20) or pressure chambers (21, 22).

4. A locking device according to claim 1, characterized in that the auxiliary energy required for locking the wing (13) in its locking position is produced by a spring means (24) including coiled compression springs or leaf springs supported at one end on the groove bottom of the axial groove (12) and at a second end on the hub-proximate end (15) of the wing (13).

5. A locking device according to claim 1, characterized in that the free end (14) of the wing (13) configured as a locking element is slightly chamfered in radial direction and configured as a pressure-application surface for the hydraulic pressure medium for the unlocking position of the wing (13), a separate pressure medium supply duct (25) opening into the widened gap thus formed between the free end (14) of the wing (13) and the groove bottom of the axial fixing groove (23) and communicating with the pressure medium supply duct (26) of the pressure) chamber (21) of the working chamber (20) in which the axial fixing groove (23) is arranged.

6. A locking device according to claim 5, characterized in that the separate pressure medium supply duct (25) to the free end (14) of the wing (13) constituting the locking element is configured in the drive pinion (3) as an edge bevel on one of the two lateral edges (17, 18) of the intermediate wall (16) adjoining the axial fixing groove (23) and defining the pressure chamber (21).

7. A locking device according to claim 5, characterized in that the separate pressure medium supply duct (25) to the free end (14) of the wing (13) constituting the locking element is configured as a pressure medium guide groove on the inner surface of one of the two side walls (6, 7) of the drive pinion (3), said separate pressure medium guide groove being arranged at a level of and parallel to the lateral surface (19) of the intermediate wall (16) adjoining the axial fixing groove (23) and defining the pressure chamber (21).

* * * * *